US009755352B2

(12) United States Patent
Hamada et al.

(10) Patent No.: US 9,755,352 B2
(45) Date of Patent: Sep. 5, 2017

(54) WATERPROOFING STRUCTURE FOR CONNECTOR

(71) Applicant: YAZAKI CORPORATION, Tokyo (JP)

(72) Inventors: Keiji Hamada, Utsunomiya (JP); Tomoyuki Miyakawa, Utsunomiya (JP)

(73) Assignee: YAZAKI CORPORATION, Tokyo (JP)

( * ) Notice: Subject to any disclaimer, the term of this patent is extended or adjusted under 35 U.S.C. 154(b) by 0 days.

(21) Appl. No.: 15/291,241

(22) Filed: Oct. 12, 2016

(65) Prior Publication Data

US 2017/0033493 A1 Feb. 2, 2017

Related U.S. Application Data

(63) Continuation of application No. PCT/JP2015/062744, filed on Apr. 27, 2015.

(30) Foreign Application Priority Data

Apr. 28, 2014 (JP) ..... 2014-093218

(51) Int. Cl.
*H01R 13/52* (2006.01)
*H01R 24/20* (2011.01)
(Continued)

(52) U.S. Cl.
CPC ..... *H01R 13/5216* (2013.01); *H01R 13/5219* (2013.01); *H01R 24/20* (2013.01);
(Continued)

(58) Field of Classification Search
CPC H01R 33/95; H01R 13/5202; H01R 13/5219; H01R 33/965; H01R 13/5216; H10R 13/521; H10R 13/52
(Continued)

(56) References Cited

U.S. PATENT DOCUMENTS 3,880,487 A 4/1975 Goodman et al.
4,698,027 A 10/1987 Vandame
5,580,266 A * 12/1996 Shelly ..... H01R 13/53 439/281

FOREIGN PATENT DOCUMENTS

JP S 49-13189 Y1 4/1974
JP S 50-70886 A 6/1975
(Continued)

OTHER PUBLICATIONS

Written Opinion dated Jun. 30, 2015, issued by the International Searching Authority in counterpart International Application No. PCT/JP2015/062744 (PCT/ISA/237).
(Continued)

*Primary Examiner* — Abdullah Riyami
*Assistant Examiner* — Justin Kratt
(74) *Attorney, Agent, or Firm* — Sughrue Mion, PLLC

(57) ABSTRACT

A waterproofing structure for a connector includes a first housing having a first terminal reception chamber for receiving a terminal and a second housing having a second terminal reception chamber for receiving a terminal. An opening end of the first terminal reception chamber is opposed to an opening end of the second terminal reception chamber, so that a gap with which circumferential edges of the opening ends are opposed to each other is configured to be sealed. An annular member made of resin is provided at the circumferential edge of the opening end of the first terminal reception chamber, the annular member having an inner circumferential surface widened toward the second housing. The circumferential edge of the opening end of the second terminal reception chamber abuts against the inner circumferential surface of the annular member.

7 Claims, 7 Drawing Sheets

(51) Int. Cl.

| | |
|---|---|
| ***H01R 24/28*** | (2011.01) |
| *H01R 33/965* | (2006.01) |
| *H01R 33/95* | (2006.01) |
| *H01R 103/00* | (2006.01) |

(52) U.S. Cl.
CPC ..... *H01R 24/28* (2013.01); *H01R 13/52* (2013.01); *H01R 13/521* (2013.01); *H01R 13/5202* (2013.01); *H01R 33/95* (2013.01); *H01R 33/965* (2013.01); *H01R 2103/00* (2013.01)

(58) Field of Classification Search
USPC ..... 439/271, 272, 273, 274, 275, 277, 281, 439/587, 588, 589
See application file for complete search history.

(56) References Cited

FOREIGN PATENT DOCUMENTS

| | | | |
|---|---|---|---|
| JP | S 61-279077 | A | 12/1986 |
| JP | 2008-66250 | A | 3/2008 |
| JP | 2009-146659 | A | 7/2009 |

OTHER PUBLICATIONS

Search Report dated Jun. 30, 2015, issued by the International Searching Authority in counterpart International Application No. PCT/JP2015/062744 (PCT/ISA/210).

* cited by examiner

WATERPROOFING STRUCTURE FOR CONNECTOR

CROSS REFERENCE TO RELATED APPLICATIONS

This application is a continuation of PCT application No. PCT/JP2015/062744, which was filed on Apr. 27, 2015 based on Japanese Patent Application (No. 2014-093218) filed on Apr. 28, 2014, the contents of which are incorporated herein by reference.

BACKGROUND OF THE INVENTION

1. Field of the Invention

The present invention relates to a waterproofing structure for a connector, and particularly relates to a waterproofing structure that seals a gap between connectors without any rubber packing.

2. Description of the Related Art

In the background art, a waterproof connector for connecting different electric wires with each other is mounted on a moving body such as a motorcycle. Such a connector is arranged to include a male housing and a female housing. The male housing receives a male terminal to which an electric wire is connected. The female housing receives a female terminal to which another electric wire is connected. When the male housing is inserted and fitted into the female housing, a gap is formed between the outer circumferential surface of the male housing and the inner circumferential surface of the female housing. A rubber packing is provided in the gap between the housings so as to prevent water from invading though the gap.

On the other hand, JP-A-2009-146659 discloses a waterproofing structure for a connector for sealing housings from each other without using any rubber packing. In the waterproof connector, a cylindrical inner hood portion is circumferentially enclosed by an outer hood portion to thereby form one of the housings. Annular seal protrusion portions are provided in both the inner circumferential surface and the outer circumferential surface of an outer cylinder respectively to thereby form the other housing.

According to the waterproof connector, when one housing is inserted and fitted to the other housing, the seal protrusion portion in the outer circumferential surface of the outer cylinder is brought into circumferential contact with the inner circumferential surface of the outer hood portion, and the seal protrusion portion in the inner circumferential surface of the outer cylinder is brought into circumferential contact with the outer circumferential surface of the inner hood portion. Thus, a waterproofing structure is formed at two places, that is, in a gap between the outer hood portion and the outer cylinder and in a gap between the inner hood portion and the outer cylinder. It is therefore possible to secure waterproofness without using any rubber packing.

However, when the housings are to be assembled with each other in the case of the waterproofing structure according to JP-A-2009-146659, the seal protrusion portions of the other housing move pressing the hood portions of the one housing respectively. Accordingly, due to friction between the seal protrusion portions and the hood portions, there arises a problem that the fitting load with which the housings are fitted to each other becomes large enough to increase the burden of the assembling work.

In addition, each seal protrusion portion abutting against the inner hood portion or the outer hood portion may be shaved. In this case, when shavings of the seal protrusion portion are put into a gap between the two housings, there is a fear that the housings cannot be fitted to each other in a regular position. Further, when the seal protrusion portion abutting against the inner hood portion or the outer hood portion is deformed, there is a fear that the force with which the seal protrusion portion can press the inner circumferential surface or the outer circumferential surface of the outer cylinder may be reduced to lower the sealing performance.

SUMMARY OF THE INVENTION

The present invention is developed in consideration of the aforementioned problems. An object of the invention is to prevent any defect from occurring due to deformation or shaving of a connector when the connector is assembled, while reducing a fitting load with which housings are fitted to each other.

In order to solve the foregoing problems, a waterproofing structure of a connector according to the invention is a structure of a connector including a first housing configured to include a first terminal reception chamber for receiving a terminal, and a second housing configured to include a second terminal reception chamber for receiving a terminal. In the structure, an opening end of the first terminal reception chamber is opposed to an opening end of the second terminal reception chamber, so that a gap with which circumferential edges of the opening ends are opposed to each other is configured to be sealed. In the structure, an annular member made of resin is provided at the circumferential edge of the opening end of the first terminal reception chamber, the annular member having an inner circumferential surface widened toward the second housing. In the structure, the circumferential edge of the opening end of the second terminal reception chamber abuts against the inner circumferential surface of the annular member.

According to the structure, the annular member is provided at the circumferential edge of the opening end of the first housing, and the second housing is made close to a predetermined position of the first housing so that the circumferential edge of the opening end of the second housing can abut against the inner circumferential surface of the annular member. Thus, the circumferential edges of the opening ends of the two housings can be sealed by the annular member. In addition, according to the structure, the second housing can keep its non-contact state until abutting against the annular member. It is therefore possible to prevent damage such as deformation or shaving during assembling, and it is also possible to reduce the fitting load between the housings.

In this case, the annular member may be formed into an umbrella shape widened toward the second housing.

According to the configuration, when the annular member is pressed against the second housing, the annular member is elastically deformed so that the widened inner circumferential surface as a whole can be further widened. When the annular member is elastically deformed thus, a restoring force (spring force) derived from the elastic deformation of the annular member acts on the circumferential edge of the opening end of the second housing. Accordingly, the gap between the annular member and the circumferential edge of the opening end of the second housing can be sealed more surely. In addition, when the connector vibrates, the annular member is opened and closed while being elastically deformed. Thus, the vibration can be absorbed. It is therefore possible to suppress propagation of the vibration to each terminal, so that the electrical connection state between the terminals can be kept excellent.

In addition, the annular member may be formed integrally with the circumferential edge of the opening end of the first terminal reception chamber.

According to the configuration, the number of components can be reduced. It is therefore possible to reduce the manufacturing cost of the components.

According to the invention, it is possible to prevent any defect from occurring due to deformation or shaving of a connector when a connector is assembled, and it is possible to reduce a fitting load with which housings are fitted to each other.

DETAILED DESCRIPTION OF THE EXEMPLARY EMBODIMENTS

An embodiment of a waterproofing structure of a connector to which the invention is applied will be described below with reference to the drawings. Although a waterproof connector to be mounted on a moving body such as a motorcycle is described in the embodiment by way of example, the connector according to the invention can be used to other applications.

Figure 1:
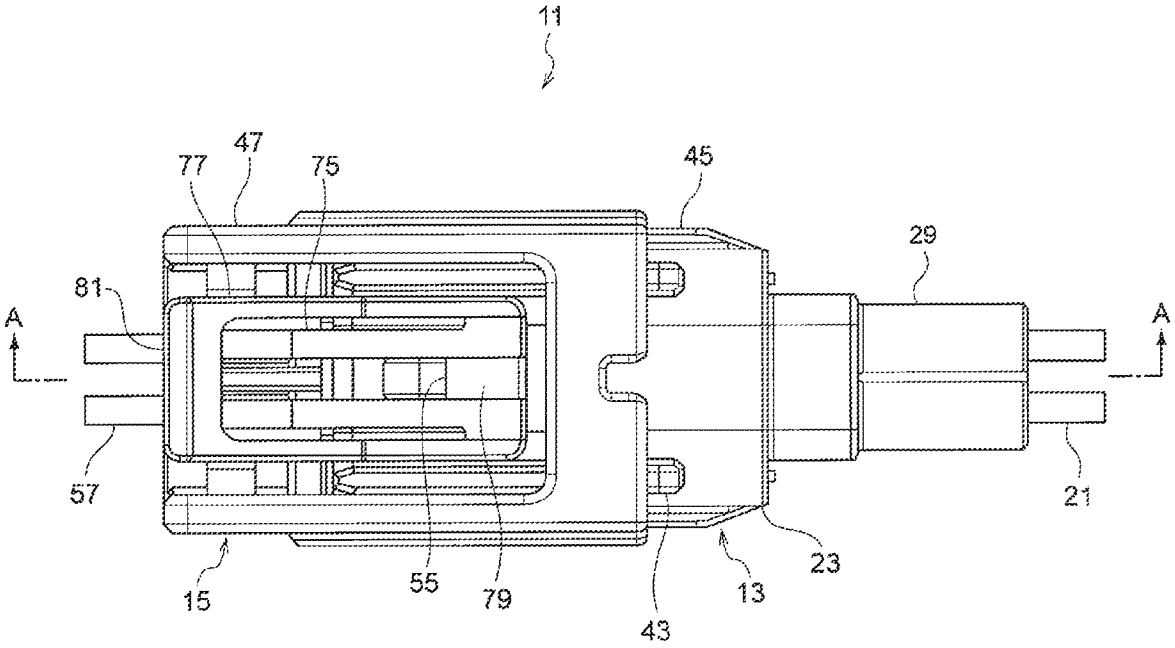
FIG. 1 is a top view of a waterproof connector according to an embodiment of the invention.
Figure 2:
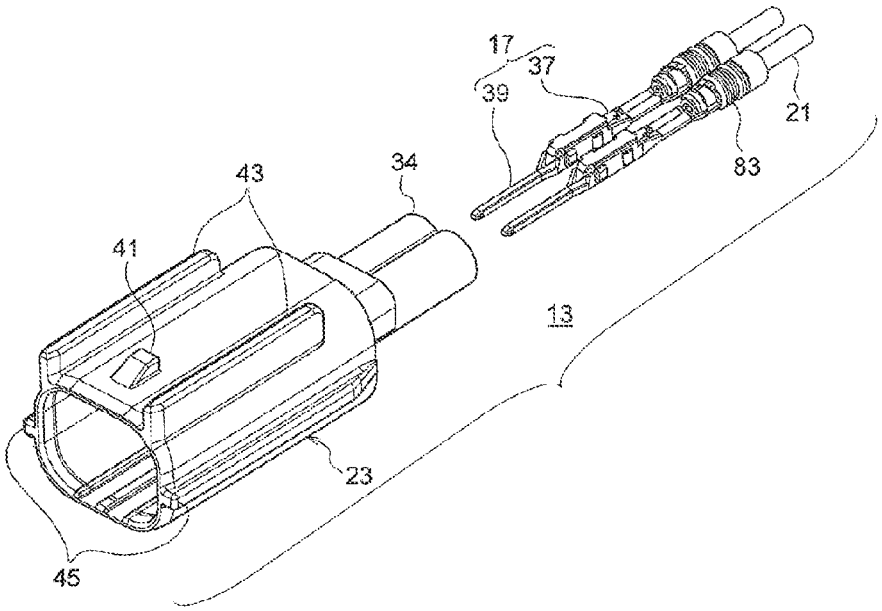
FIG. 2 is an exploded perspective view of a male connector constituting the waterproof connector in FIG. 1.
Figure 3:
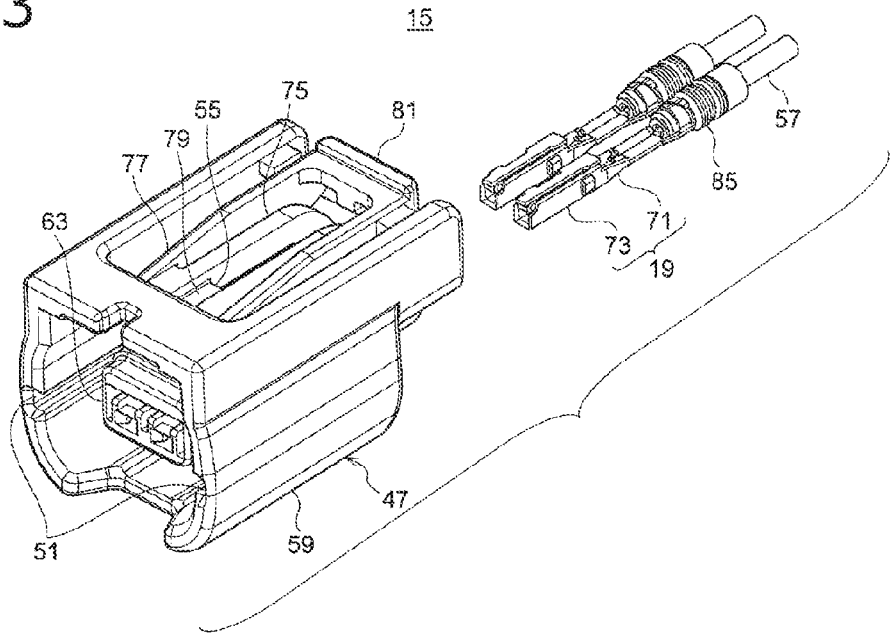
FIG. 3 is an exploded perspective view of a female connector constituting the waterproof connector in FIG. 1.
Figure 4:
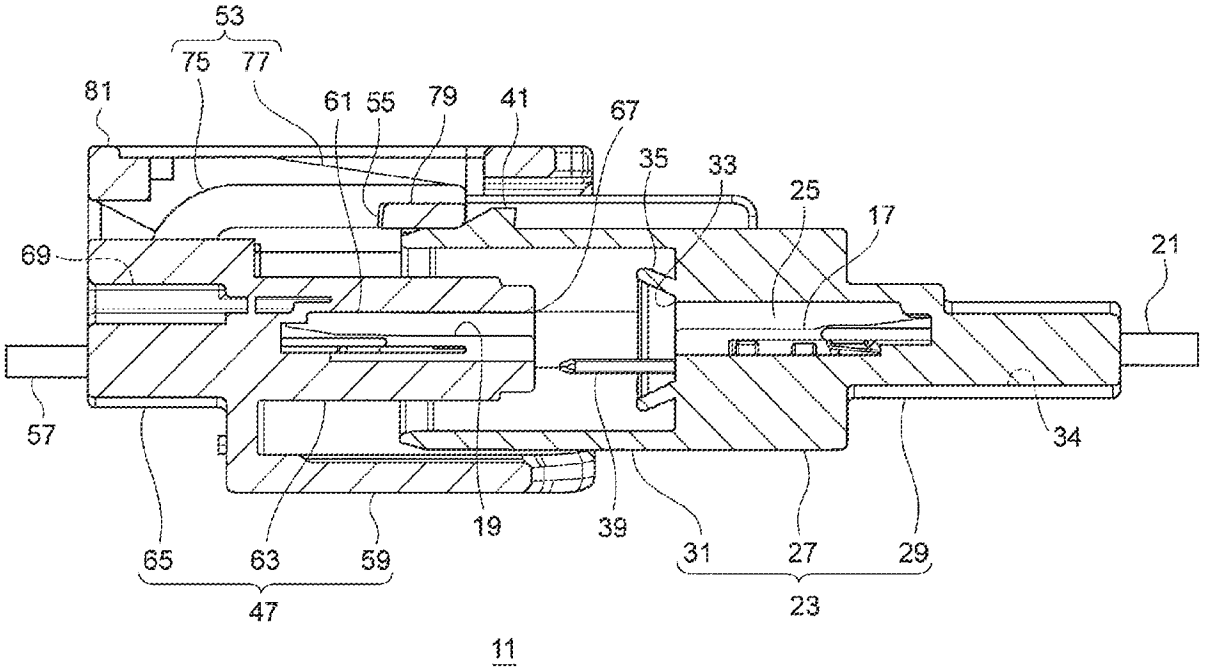
FIG. 4 is a longitudinal sectional view in which the male connector and the female connector are not fitted to each other yet.
Figure 5B:
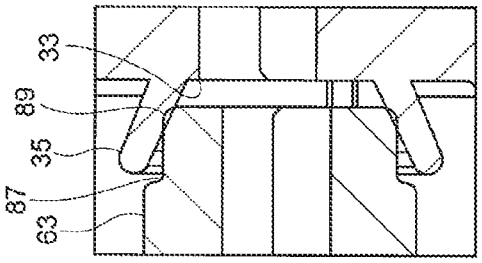
FIG. 5A and FIG. 5B are longitudinal sectional views in which the male connector and the female connector are fitted to each other.
Figure 5A:
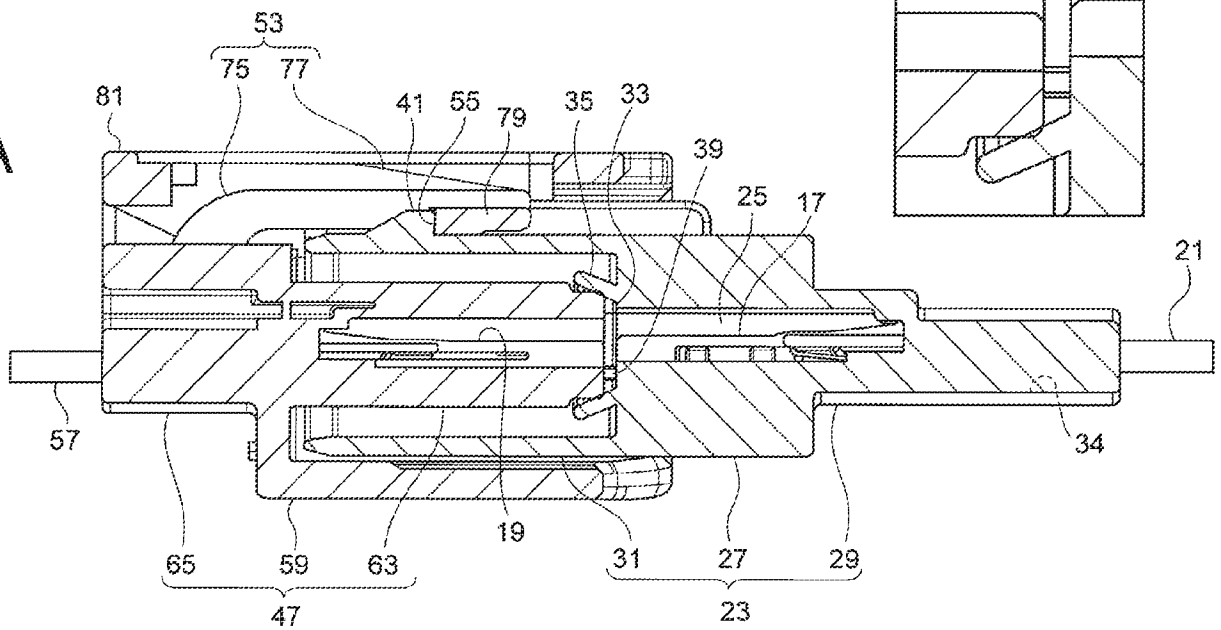

FIG. 1 is a top view of a waterproof connector according to an embodiment of the invention. FIG. 2 is an exploded perspective view of a male connector constituting the waterproof connector in FIG. 1. FIG. 3 is an exploded perspective view of a female connector constituting the waterproof connector in FIG. 1. FIG. 4, FIG. 5A and FIG. 5B show sectional views taken from the arrow direction A-A in FIG. 1. FIG. 4 shows a state in which the male connector and the female connector are not fitted to each other yet. FIG. 5A and FIG. 5B show a state in which the male connector and the female connector are fitted to each other.

As shown in FIG. 1, in a waterproof connector 11, a male connector 13 and a female connector 15 are connected (fitted) to each other so that male terminals 17 received in the male connector 13 can be electrically connected to female terminals 19 received in the female connector 15. Electric wires are connected to the terminals respectively. Each of the male connector 13 and the female connector 15 is formed into a cylindrical shape out of insulating synthetic resin. Incidentally, in the following description, define the right side and the left side in FIG. 1 as a rear side and a front side respectively. These definitions can be suitably applied to description of the other drawings.

As shown in FIGS. 2 and 4, the male connector 13 is provided with male terminals 17 to which electric wires 21 are connected, and a male housing 23 (first housing) that receives the male terminals 17. The male housing 23 has a cylindrical base portion 27, an electric wire holding portion 29, and a hood portion 31 integrally. In the base portion 27, a male terminal reception chamber 25 for receiving the male terminals 17 is formed. The electric wire holding portion 29 protrudes rearwards from the base portion 27. The hood portion 31 protrudes frontwards from the base portion 27. The hood portion 31 is formed into a rectangular cylindrical shape with a circumferential wall continuously connected to a circumferential wall of the base portion 27.

The male terminal reception chamber 25 receives a plurality (for example, two) of male terminals 17 so that the male terminals 17 can be separated from each other by a not-shown partition wall, and each male terminal 17 can be held in a set position by a lance. The male terminal reception chamber 25 is formed to communicate with an opening end 33 of a front end surface of the base portion 27 surrounded by the hood portion 31, and also communicate with a through hole 34 receiving the electric wires 21 in the electric wire holding portion 29. An annular member 35 that will be described later is provided at the circumferential edge of the opening end 33.

As shown in FIG. 2, each male terminal 17 is formed out of a conductive metal plate material or the like. The male terminal 17 has an electric wire connection portion 37 and a male tub 39 integrally. The electric wire connection portion 37 makes connection with a core wire of an electric wire 21 by crimping. The male tube 39 is formed into a rod-like shape extending straightly. The male tub 39 is provided to protrude from the opening end 33 and extend frontwards from the annular member 35 in the state where the male terminal 17 is received in a set position of the male terminal reception chamber 25.

A lock protrusion 41, a pair of first guide ribs 43, and a pair of second guide ribs 45 are provided in the hood portion 31 so as to protrude outward individually. The pair of first guide ribs 43 and the pair of second guide ribs 45 are provided and formed to extend in the fitting direction between the male connector 13 and the female connector 15. The lock protrusion 41 is provided inside the pair of first guide ribs 43. As will be described later, the first guide ribs 43 and the second guide ribs 45 are guided along guide grooves 51 in an inner wall of a female housing 47 respectively so as to fit the male connector 13 and the female connector 15 to each other in a regular direction. The lock protrusion 41 engages with an engagement portion 55 of a lock arm 53 in the male connector 13, as will be described later.

On the other hand, as shown in FIGS. 3 and 4, the female connector 15 has female terminals 19 to which electric wires 57 are connected, and a female housing 47 (second housing) that receives the female terminals 19. The female housing 47 has an outer cylinder portion 59, an inner cylinder portion 6 and a cylindrical electric wire holding portion 65 integrally. The outer cylinder portion 59 is formed into a rectangular cylindrical shape. The inner cylinder portion 63 is received in the outer cylinder portion 59. The inner cylinder portion 63 is formed into a rectangular cylindrical shape including a female terminal reception chamber 61 in which the female terminals 19 are received. The electric wire holding portion 65 is continuously connected to the inner cylinder portion 63 and extended frontwards on the opposite side to the fitting direction of the female connector 15.

When the male connector 13 and the female connector 15 are fitted to each other, the hood portion 31 of the male housing 23 is inserted into an annular gap between the outer cylinder portion 59 and the inner cylinder portion 63. On this occasion, the outer circumferential surface of the inner cylinder 63 received inside the hood portion 31 is provided at a predetermined circumferential distance from the inner circumferential surface of the hood portion 31.

The female terminal reception chamber 61 receives a plurality (for example, two) of female terminals 19 so that the female terminals 19 can be separated from each other by a not-shown partition wall, and each female terminal 19 can be held in a set position by a lance. The female terminal reception chamber 61 is formed to communicate with an opening end 67 of a front end surface of the inner cylinder portion 63 surrounded by the outer cylinder portion 59, and also communicate with a through hole 69 receiving the electric wires 57 in the electric wire holding portion 65.

Each female terminal 19 is formed out of a conductive metal plate material or the like. The female terminal 19 has an electric wire connection portion 71 and a cylindrical electric contact portion 73 integrally. The electric wire connection portion 71 makes connection with a core wire of an electric wire 57 by crimping. The electric contact portion 73 is continuously connected to the electric wire connection portion 71. The electric contact portion 73 is disposed to be flush with the opening end 67 or to be brought back by a set distance from the opening end 67 in the state where the female terminal 19 is received in a set position of the female terminal reception chamber 61. When the electric contact portion 73 enters the inside of the male tub 39 of the male terminal 17, the electric contact portion 73 is electrically connected to the male terminal 17.

Four guide grooves 51 are provided in the inner wall of the outer cylinder portion 59. The guide grooves 51 are provided in the direction in which the hood portion 31 of the male housing 23 is inserted. The aforementioned pair of first guide ribs 43 and the aforementioned pair of second guide ribs 45 of the male housing 23 can be inserted into the guide grooves 51 respectively.

A lock arm 53 is provided in the outer cylinder portion 59. As shown in FIG. 4, the lock arm 53 has a pair of foot portions 75 and a lock portion 77. The foot portions 75 are provided erectly from the front end side (left side in FIG. 4) of the outer cylinder portion 59 so as to extend on the rear end side of the outer cylinder portion 59. The lock portion 77 is supported by rear end parts of the foot portions 75 so as to extend like a cantilever extending on the front end side of the outer cylinder portion 59. The pair of foot portions 75 are coupled with each other on their rear end side by a first coupling portion 79, and front end parts of the pair of lock portions 77 are coupled with each other by a second coupling portion 81. The aforementioned lock protrusion 41 of the male housing 23 is engaged with an engagement portion 55 formed between the pair of foot portions 75 and the first coupling portion 79, so that the fitting state between the male housing 23 and the female housing 47 can be retained.

As shown in FIG. 2, an annular waterproofing stopper 83 is attached to each electric wire 21. In the state where the male terminal 17 is received in a regular position of the male terminal reception chamber 25, the waterproofing stopper 83 can seal a gap between the outer circumferential surface of the electric wire 21 extracted from the through hole 34 of the electric wire holding portion 29 and the inner circumferential surface of the through hole 34. In the same manner, as shown in FIG. 3, an annular waterproofing stopper 85 is attached to each electric wire 57. In the state where the male terminal 19 is received in a regular position of the male terminal reception chamber 25, the waterproofing stopper 85 can seal a gap between the outer circumferential surface of the electric wire 57 extracted from the through hole 69 of the electric wire holding portion 65 and the inner circumferential surface of the through hole 69.

Figure 6:
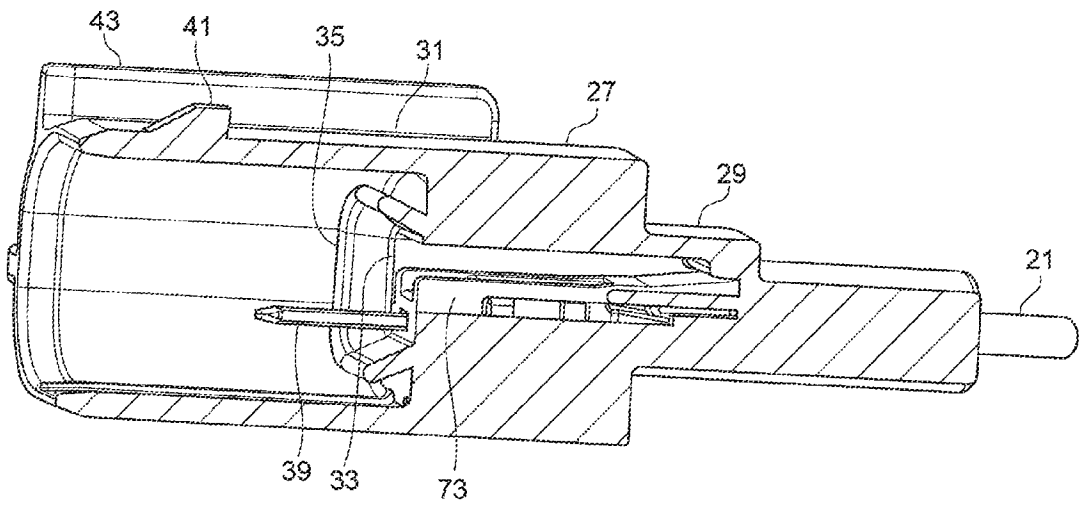
FIG. 6 is a view showing a longitudinal section of the male connector.
Figure 7:
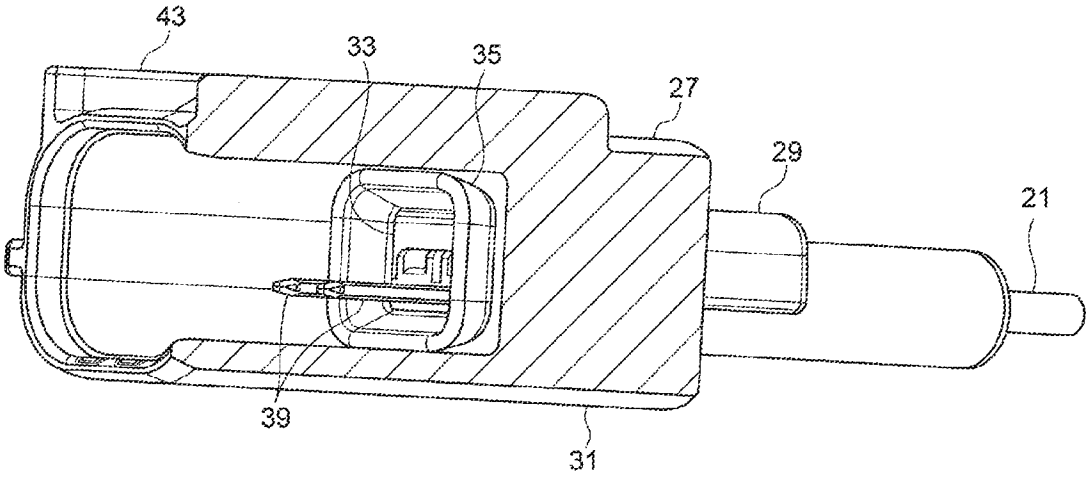
FIG. 7 is a perspective view showing a longitudinal section of the male connector.

Next, the annular member 35 serving as a constituent characterizing the embodiment will be described. FIG. 6 is a perspective view showing a longitudinal section of the male housing 23 taken from the arrow direction A-A in FIG. 1. FIG. 7 is a perspective view showing a longitudinal section displaced by an angle from the sectional view of FIG. 6.

In the embodiment, the opening end 67 of the female housing 47 is opposed to the opening end 33 located in the front end surface of the base portion 27 of the male housing 23, and the annular member 35 made of synthetic resin is provided in a gap in which the circumferential edges of the opening ends are opposed to each other. The annular member 35 is provided to protrude from the circumferential edge of the opening end 33, and formed integrally with the male housing 23. The annular member 35 is formed into an umbrella shape having a rectangular cylindrical cross section corresponding to the rectangular cylindrical sectional shape of the inner cylinder portion 63 of the female housing 47. The annular member 35 has an inner circumferential surface and an outer circumferential surface widened toward the female housing.

The annular member 35 is formed so that all the circumferential edge of the opening end 67 of the inner cylinder portion 63 can abut against the widened inner circumferential surface of the annular member 35 when the male housing 23 and the female housing 47 are fitted to each other in a regular position. In addition, since the annular member 35 is formed out of the same synthetic resin as the male housing 23, the annular member 35 can be elastically deformed in a direction to expand its inner circumferential surface (in a direction to contract axially) when the inner circumferential surface is pressed against the circumferential edge of the opening end 67 of the inner cylinder portion 63.

When the aforementioned waterproof connector 11 is assembled, each male terminal 17 to which an electric wire 21 is connected is first inserted through the through hole 34 of the male housing 23. The male terminal 17 is received in a predetermined position of the male terminal reception chamber 25, and retained by a lance. At the same time, the waterproofing stopper 83 attached to the electric wire 21 is pushed into the through hole 34 to thereby seal the gap with the through hole 34. Thus, the male tub 39 is placed to penetrate the annular member 35 and protrude therefrom.

On the other hand, each female terminal 19 to which an electric wire 57 is connected is inserted through the through hole 69 of the female housing 47. The female terminal 19 is received in a predetermined position of the female terminal reception chamber 61, and retained by a lance. At the same time, the waterproofing stopper 85 attached to the electric wire 57 is pushed into the through hole 34 to thereby seal the gap with the through hole 34.

Next, as shown in FIG. 4, the male housing 23 and the female housing 47 are opposed to each other, and the male housing 23 and the female housing 47 are made close to each other. On this occasion, the first guide ribs 43 and the second guide ribs 45 of the male housing 23 are fitted into the guide grooves 51 of the female housing 47 respectively so that the male housing 23 can keep its regular posture while the hood portion 31 is guided to the gap between the outer cylinder portion 59 and the inner cylinder portion 63.

First, when the male housing 23 and the female housing 47 are made close to each other in this manner, the front end portion of the male tub 39 protruding from the opening end 33 of the male housing 23 enters the electric contact portion 73 (see FIG. 3) of the female terminal 19 through the opening end 67 of the female housing 47.

Next, when the female housing 47 is fitted in a regular position to the male housing 23 as shown in FIG. 5A and FIG. 5B, the circumferential edge of the opening end 67 of the inner cylinder portion 63 of the female housing 47 abuts against the inner circumferential surface of the annular member 35 of the male housing 23 as shown in FIG. 5A and FIG. 5B. In addition, the front end portion of the male tub 39 is received in a regular position of the electric contact portion 73 of the female terminal 19. Thus, the electric connection between the male terminal 17 and the female terminal 19 is completed.

Then, in the inner cylinder portion 63 abutting against the inner circumferential surface of the annular member 35 the circumferential edge of the opening end 67 presses the inner circumferential surface of the annular member 35 from a circumferential direction. Thus, the annular member 35 is elastically deformed in a direction to expand its inner circumferential surface (in a direction to contract axially). As a result, the restoring force deriving from the elastically deformed annular member 35 acts all over the circumferential edge of the opening end 67 of the inner cylinder portion 63. Accordingly, the circumferential edge of the opening end 67 of the inner cylinder portion 63 is strongly pressed onto the inner circumferential surface of the annular member 35 so that the gap between the opening end 67 of the female housing 47 and the opening end 33 of the male housing 23 can be airtightly sealed through the annular member 35.

On the other hand, in the course in which the male housing 23 and the female housing 47 are made close to each other, the lock protrusion 41 provided in the male housing 23 abuts against the first coupling portion 79 formed in the lock arm 53 of the female housing 47. Thus, the pair of foot portions 75 continuously connected to the first coupling portion 79 are elastically deformed so that the lock protrusion 41 can get over the first coupling portion 79 and engage with the engagement portion 55. As a result, the relative positions of the female housing 47 and the male housing 23 to each other can be retained to keep the state in which the circumferential edge of the opening end 67 of the inner cylinder portion 63 is pressing the annular member 35. It is therefore possible to prevent water from invading through the gap between the annular member 35 and the circumferential edge of the opening end 67 of the female housing 47.

Further, the gap between the through hole 34 and the electric wire 21 is sealed by the waterproofing stopper 83, and the gap between the through hole 69 and the electric wire 57 is sealed by the waterproofing stopper 85. Accordingly, the male terminal reception chamber 25 and the female terminal reception chamber 61 can be perfectly prevented from being invaded by water from the outside. Thus, the connection state between the male terminal 17 and the female terminal 19 can be kept excellent.

In addition, the annular member 35 is brought into contact with the inner cylinder portion 63 so that the annular member 35 can be elastically deformed. Accordingly, when the waterproof connector 11 vibrates, the annular member 35 repeats elastic deformation, for example, to expand and contract axially (open and close its inner circumferential surface), so that the vibration can be absorbed. Thus, propagation of the vibration to each terminal 17, 19 can be suppressed so that the electric connection state between the terminals can be kept excellent.

According to the embodiment, as is described, the annular member 35 made of resin and formed into an umbrella shape widened toward the female housing 47 is provided at the circumferential edge of the opening end 33 of the base portion 27 of the male housing 23. When the male housing 23 and the female housing 47 are fitted to each other in a regular position, the inner circumferential surface of the annular member 35 is pressed by the circumferential edge of the opening end 67 of the inner cylinder portion 63 of the female housing 47. Thus, the inner circumferential surface of the annular member 35 is deformed elastically. As a result, the contact region between the circumferential edge of the opening end 67 of the inner cylinder portion 63 and the inner circumferential surface of the annular member 35 is brought into strongly tight contact circumferentially. Thus, water can be prevented from invading through the contact region. Incidentally, in the waterproof connector 11 according to the embodiment, the pressing amount (insertion amount) with which the annular portion 35 is pressed is set suitably so that the opening end 67 of the inner cylinder portion 63 can press the annular member 35 within an elastically deformable range of the annular member 35.

According to the embodiment, when the male housing 23 and the female housing 47 are fitted to each other, the circumferential edge of the opening end 67 of the inner cylinder portion 63 can keep its non-contact state until abutting against the annular member 35. It is therefore possible to prevent damage caused by the fitting between the male housing 23 and the female housing 47. In addition, the fitting load of the two housings is reduced so that the burden of assembling work can be reduced.

According to the embodiment, the annular member 35 can be formed integrally with the male housing 23 by molding. Thus, the number of components can be reduced, and the number of manufacturing man-hours or the manufacturing cost of the components can be reduced. In addition, it is possible to abolish any rubber packing that is used in a background-art seal structure. Accordingly, it is not necessary to take the thickness of the rubber packing into consideration as to a width dimension in a direction crossing the axial direction of the connector. It is therefore possible to make the connector compact. Further, when the annular member 35 is formed out of a general-purpose synthetic resin material or the like, deterioration with age appearing as in a rubber material can be prevented. Thus, it is possible to prevent the sealing performance from deteriorating with age.

In addition, according to the embodiment, as shown in FIG. 5A and FIG. 5B, when a front end part of the inner cylinder portion 63 is observed from its sectional direction, the female housing 47 is provided with a step portion 87 whose width dimension in a direction perpendicular to the axial direction is reduced on the opening end 67 side. Accordingly, for example, even when foreign matter adheres to the vicinity of the opening end 67 of the inner cylinder portion 63, the foreign matter can be released to the step portion 87. As a result, a seal surface 89 of the inner cylinder portion 63 abutting against the annular member 35 can be prevented from being damaged by foreign matter placed between the seal surface 89 and the annular member 35. Thus, the sealing performance can be prevented from deteriorating.

Although the invention is described in detail and with reference to its specific embodiment, it is obvious for those skilled in the art that various changes or modifications can be made on the invention without departing from the spirit and scope thereof.

For example, the annular member 35 may be formed separately from the male housing 23. In this case, the annular member may be formed at the circumferential edge of the opening end 33 so as to include a disc-like bottom plate attached along an end face of the base portion 27, and an annular member protruding to be widened from the bottom plate. The annular member may be molded out of desired synthetic resin.

In addition, it will go well only if the annular member 35 has an inner circumferential surface against which the inner cylinder portion 63 of the female housing 47 can abut circumferentially. When the inner cylinder portion 63 is, for example, formed into a circular cylindrical shape, the annular member 35 is formed into a circular cylindrical umbrella shape corresponding to the shape of the inner cylinder portion 63.

Figure 8:
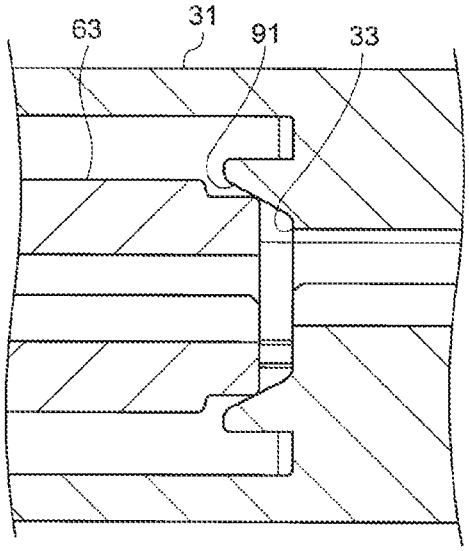
FIG. 8 is a sectional view showing another embodiment of an annular member.
Figure 9:
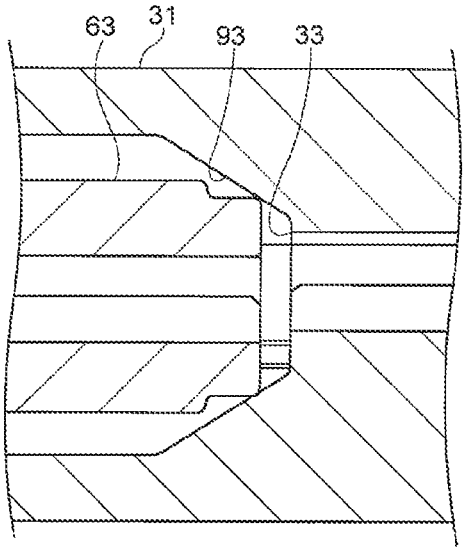
FIG. 9 is a sectional view showing another embodiment of the annular member.

In addition, in the aforementioned embodiment, the annular member 35 is formed into an umbrella shape so that the annular member 35 can be elastically deformed easily. However, the annular member 35 may be, for example, formed into a triangular shape in section as shown in FIG. 8 (the reference numeral 91), or a tapered slope may be formed from the circumferential edge of the opening end 33 toward the inner circumferential surface of the hood portion 31 as shown in FIG. 9 (the reference numeral 93). According to these examples, the elastic deformation is reduced in comparison with that in the annular member 35 having an umbrella shape. However, due to easiness in shaping, a mold for molding the annular shape 35 can be produced at a low price. In addition, even when the annular member 35 is formed thus, a predetermined degree of tight contact can be secured in a region against which the inner cylinder portion 63 abuts. It is therefore possible to prevent water from invading a space formed by the inner cylinder portion 63 and the annular member.

Here, the features of the aforementioned embodiment of the waterproof structure of a connector according the invention will be summarized and listed briefly in the following paragraphs [1] to [3] respectively.

[1] A waterproofing structure of a connector (waterproof connector 11) including:

a first housing (male housing 23) configured to include a first terminal reception chamber (male terminal reception chamber 25) for receiving a terminal (male terminal 17); and a second housing (female housing 47) configured to include a second terminal reception chamber (female terminal reception chamber 61) for receiving a terminal (female terminal 19), wherein an opening end (33) of the first terminal reception chamber is opposed to an opening end (67) of the second terminal reception chamber, so that a gap with which circumferential edges of the opening ends are opposed to each other is configured to be sealed;

wherein an annular member (35) made of resin is provided at the circumferential edge of the opening end of the first terminal reception chamber, the annular member having an inner circumferential surface widened toward the second housing; and wherein the circumferential edge of the opening end of the second terminal reception chamber can abut against the inner circumferential surface of the annular member.

[2] The waterproofing structure of a connector according to the aforementioned paragraph [1], wherein the annular member has an umbrella shape widened toward the second housing.

[3] The waterproofing structure of a connector according to the aforementioned paragraph [1] or [2], wherein the annular member is formed integrally with the circumferential edge of the opening end of the first terminal reception chamber.

According to the invention, there is an advantage that it is possible to prevent any defect from occurring due to deformation or shaving of a connector when the connector is assembled, and it is possible to reduce a fitting load with which housings are fitted to each other. The invention exerting the advantage is useful to a waterproofing structure for sealing a gap between connectors without using any rubber packing.

The invention claimed is:

1. A waterproofing structure for a connector comprising:

a first housing configured to comprise a first terminal reception chamber for receiving a terminal; and a second housing configured to comprise a second terminal reception chamber for receiving a terminal, wherein an opening end of the first terminal reception chamber is opposed to an opening end of the second terminal reception chamber, so that a gap with which circumferential edges of the opening ends are opposed to each other is configured to be sealed;

wherein an annular member made of resin is provided at the circumferential edge of the opening end of the first terminal reception chamber, the annular member having an inner circumferential surface widened toward the second housing;

wherein the circumferential edge of the opening end of the second terminal reception chamber abuts against the inner circumferential surface of the annular member; and wherein a space is provided immediately adjacent to the outer circumferential surface of the annular member so as to allow outward deformation of the annular member.

2. The waterproofing structure for a connector according to claim 1, wherein the annular member has an umbrella shape widened toward the second housing.

3. The waterproofing structure for a connector according to claim 1, wherein the annular member is formed integrally with the circumferential edge of the opening end of the first terminal reception chamber.

4. The waterproofing structure for a connector according to claim 1, wherein the opening end of the second terminal reception chamber is provided with a step portion whose width in a direction perpendicular to the axial direction is reduced toward the first housing.

5. The waterproofing structure for a connector according to claim 1, wherein the annular member has a triangular shape widened toward the second housing.

6. The waterproofing structure for a connector according to claim 1, wherein the annular member has a tapered slope widened toward the second housing.

7. A waterproofing structure for a connector comprising:

a first housing configured to comprise a first terminal reception chamber for receiving a terminal; and a second housing configured to comprise a second terminal reception chamber for receiving a terminal, wherein an opening end of the first terminal reception chamber is opposed to an opening end of the second terminal reception chamber, so that a gap with which circumferential edges of the opening ends are opposed to each other is configured to be sealed;

wherein an annular member made of resin is provided at the circumferential edge of the opening end of the first terminal reception chamber, the annular member having an inner circumferential surface widened toward the second housing;

wherein the circumferential edge of the opening end of the second terminal reception chamber abuts against the inner circumferential surface of the annular member; and wherein when the connector vibrates, the annular member is opened and closed against the circumferential edge of the opening end of the second terminal reception chamber.

* * * * *